United States Patent [19]

Clark et al.

[11] 4,444,102

[45] Apr. 24, 1984

[54] SELF ALIGNING DOCTOR/APPLICATOR BLADE ASSEMBLY

[75] Inventors: Edwin E. Clark, Knoxville, Pa.; William E. Lock, Horseheads, N.Y.; Paul E. Paiement, deceased, late of Horseheads, N.Y.; by Paula J. Miles, executrix, Erin, N.Y.

[73] Assignee: Corning Glass Works, Corning, N.Y.

[21] Appl. No.: 332,724

[22] Filed: Dec. 21, 1981

[51] Int. Cl.[3] ..... B41F 9/10; B41F 17/28; B41M 1/10

[52] U.S. Cl. ..... 101/36; 101/154; 101/157; 101/170

[58] Field of Search ..... 101/157, 169, 38 R, 101/38 A, 154, 155, 170, 36; 118/409

[56] References Cited

U.S. PATENT DOCUMENTS

| | | | |
|---|---|---|---|
| Re. 21,212 | 9/1939 | Weiss | 101/170 |
| 155,072 | 9/1874 | Davies | 101/38 R |
| 450,369 | 4/1891 | Kellberg | 101/248 |
| 668,358 | 2/1901 | Smith | 101/170 |
| 799,389 | 9/1905 | Krasky | 101/154 |
| 1,774,119 | 8/1930 | Waller | 101/157 |
| 2,047,993 | 7/1936 | Bingham | 118/409 |
| 2,151,969 | 3/1939 | Henderson | 101/157 |
| 2,278,387 | 3/1942 | Wickwire | 101/157 |
| 2,891,471 | 6/1959 | Sengewald | 101/169 |
| 3,007,404 | 11/1961 | Crawford | 101/170 |
| 3,400,658 | 9/1968 | Gaghiardi | 101/170 |
| 3,762,319 | 10/1973 | Gazzole | 101/155 |
| 3,977,318 | 8/1976 | Cohan | 101/38 A |
| 4,009,657 | 3/1977 | Bonanno | 101/169 |
| 4,026,210 | 5/1977 | Merzogora | 101/169 |
| 4,085,672 | 4/1978 | Grosart | 101/169 |
| 4,151,797 | 5/1979 | Dunsirn | 101/169 |

FOREIGN PATENT DOCUMENTS

| | | | |
|---|---|---|---|
| 238743 | 8/1925 | United Kingdom | 101/157 |
| 366724 | 2/1932 | United Kingdom | 101/157 |
| 369738 | 3/1932 | United Kingdom | 101/169 |
| 1284841 | 8/1972 | United Kingdom | 101/38 R |

*Primary Examiner*—Clyde I. Coughenour
*Attorney, Agent, or Firm*—B. R. Turner

[57] ABSTRACT

The apparatus of the present invention includes a self aligning applicator/doctor blade assembly having at least two working surfaces adapted to engage an ink carrying conical roll wherein the working surfaces lie along the roll surface. A geometric apex for the cone and the working surfaces are coincident. An inking device circulates ink along a path including a zone adjacent to at least one working surface and the roll.

30 Claims, 12 Drawing Figures

SELF ALIGNING DOCTOR/APPLICATOR BLADE ASSEMBLY

BACKGROUND OF THE INVENTION

The present invention relates to a printing apparatus and a method of carrying out various printing functions. Although many applications for the invention may be possible, the disclosure herein emphasizes the application to ware decoration. It should be understood that articles of many types may be printed or decorated using the apparatus and method of the present invention and such applications are part of the invention herein.

In multicolor ware decoration, speed, versatility, ease of setup, quality of reproduction, accuracy of registration, and cost effectiveness are important factors to consider. State of the art decorating devices approach some but not all of the above factors satisfactorily. The present invention was developed for various reasons including a desire to both take advantage of the latest ink and elastomer technology and to maximize printing rates without sacrifice of registration.

The machine configuration of the present invention makes use of two geometric relationships illustrated in FIGS. 1–3. First, a cone when placed on the flat surface and rolled, will trace an arc centered along a center line of the arc at the same point as the apex of the cone. The cone will travel along this path freely with no slipping between the surfaces. Second, two cones sharing the same apex and placed side by side will roll one on the other without slipping along a line of contact or common ray of the cones. By choosing the proper ratio of circumferences between the first mentioned cone and the arc traced in the plane of the flat surface, the cone will roll an integral number of revolutions as it travels one revolution about the traced arc. Similarly the proper choice of circumference ratios of cones will produce integral rotations with each other and the arc. Therefore, discrete locations of the cone will always match up with discrete locations along the arc in the flat surface. Accordingly, a special case of synchronous motion may be defined.

The two cones and the flat surface may be driven in synchronism by a proper gearing arrangement, from which a device may be produced which will establish pattern registration from one set of cones to another and the surface as hereinafter illustrated.

The present invention provides means incorporating a working surface lying in a surface complimentary with the cone, adapted to engage the same, and provide a self aligning doctoring device requiring little or no adjustment. An additional feature of the present invention includes a simple ink circulating system taking advantage of the self aligning feature. The device herein described may be adapted for printing multicolor designs on flat, hollow, and other odd shaped ware inside or out, with high quality, high speed, and simplified set up for each of the various types of ware to be decorated with a degree of versatility not heretofore available in the prior art.

In a series of related U.S. patent application Ser. Nos. 332,722; 332,723; 332,725 and 332,726 filed this same date and assigned to the assignee herein, various apparatus and sub-combinations therefor useful with the present invention are disclosed in detail. It should be understood that, to the extent necessary, the teachings of said applications should be considered incorporated by reference herein.

SUMMARY OF THE INVENTION

The apparatus of the present invention includes a self aligning applicator/doctor blade assembly having at least two working surfaces adapted to engage an ink carrying conical roll wherein the working surfaces lie along the roll surface. A geometric apex for the cone and the working surfaces are coincident. An inking device circulates ink along a path including a zone adjacent to at least one working surface and the roll.

DESCRIPTION OF THE PREFERRED EMBODIMENT

Figure 1:
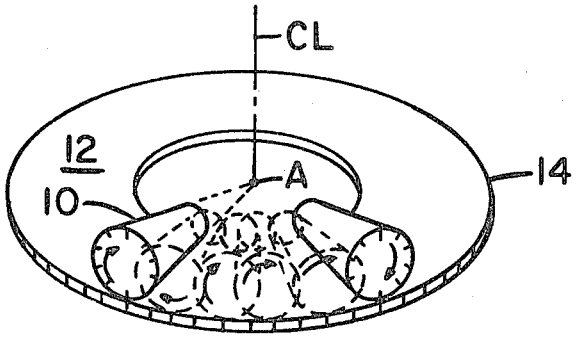
FIGS. 1–3 show geometric relationships of various components and illustrate the operating principle of the apparatus of the present invention.

The configuration of the present invention makes use of two geometric relationships. First, referring to FIG. 1, a cone 10 (truncated as shown), having an apex point A, when placed on a flat surface 12 and rolled, will trace a circular arc or disk 14 centered at the same point as the apex A of the cone 10 along center line CL of the arc 14. The cone 10 will travel along this path freely with no slipping. Second, referring to FIG. 2, two cones (in transparency), the first mentioned 10 above and another 16 having the same apex A and placed side by side, roll one on the other with no slipping along the line of contact or common ray 18 shared by the cones.

Figure 2:
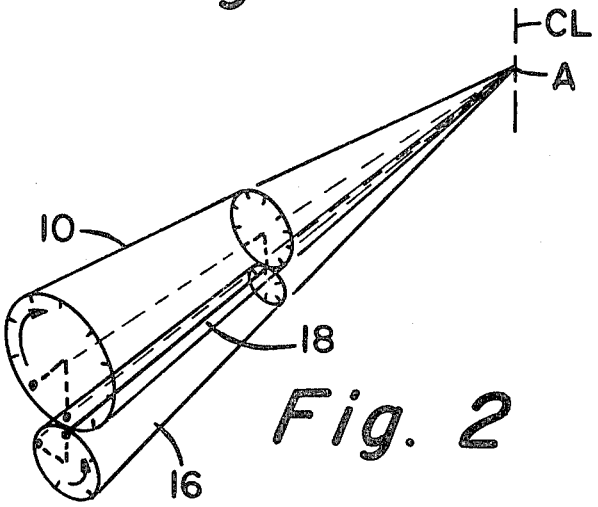
Figure 3:
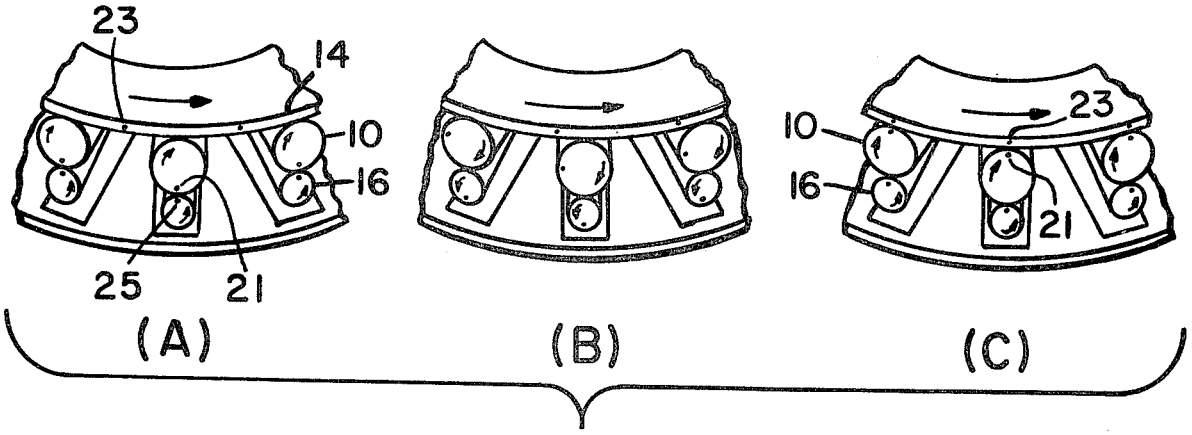

FIGS. 3 at (A)–(C) illustrates that by combining the principles of FIGS. 1 and 2 and by choosing the proper ratio of circumferences between the arc 14 and cone 10, the latter will roll an integral number of revolutions as it travels one revolution around arc 14. This means that discrete locations 21 on the cone 10 will always match up with the discrete locations 23 on the arc 14. Likewise by choosing the proper ratios of circumferences between the two cones 10 and 16, one will rotate an integral number of times for each revolution of the other. Thus, discrete locations 25 on the cone 16 will always match those discrete locations 21 on cone 10 as the cones are continuously rotated.

Figure 4:
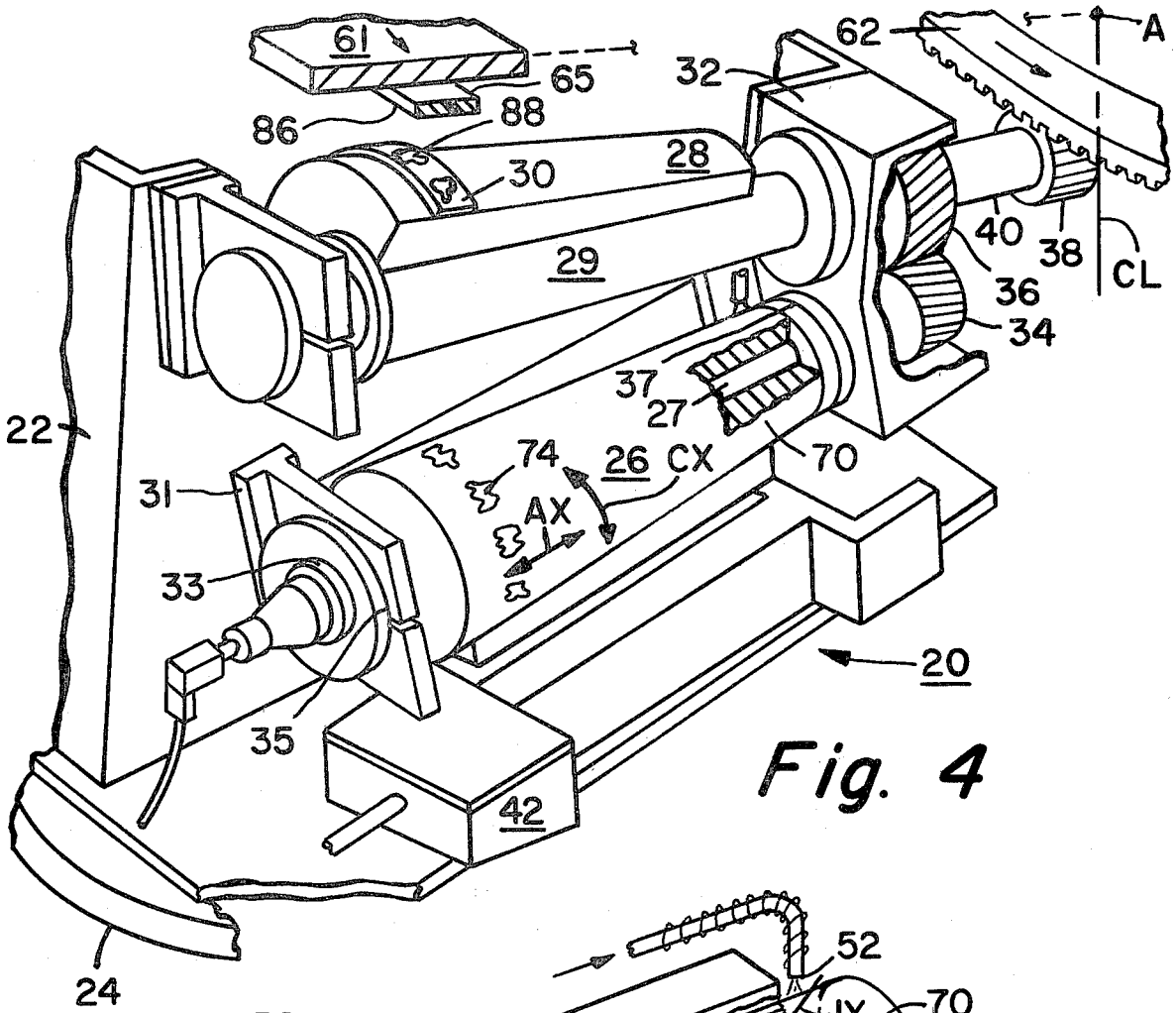
FIG. 4 is a fragmented perspective view of a printing device incorporating the principles of the present invention.

FIG. 4 is an illustration of a single printing station assembly 20 for a printing device as illustrated in Ser. No. 332,726 referred to above. It includes a vertical mounting frame 22, attached to a stationary table 24, onto which are mounted one etch cone 26 carried by shaft 27, and one transfer cone 28 mounted on shaft 29. The transfer cone 28 carries a silicone transfer surface 30. A gear box 32 houses two spiral bevel gears 34 and 36 mounted respectively on shafts 27 and 29. Pinion gear 38 is carried on an extension 40 of shaft 29. The printing station assembly 20 also includes an ink applicator assembly 42 detailed in FIG. 5 and described hereinafter.

Etch cone 26 and transfer cone 28 are each adjustable in axial and circumferential directions. The shaft 27 carrying etch cone 26 is mounted between end support 31 carried by vertical mounting frame 22 and gear box 32. The etch cone 26 is sleeved onto shaft 27 and is free to be moved axially thereof in the direction of double headed arrow AX by means of locking collar 33 supported in opening 35 of end support 31. The locking collar 33 may be a concentric shaft arrangement or screw advance (not shown) to engage the etch cone 26 and shaft 27 and thereby permit adjustment of the axial position of etch cone 26. The etch cone 26 is further adapted to be circumferentially moved relative to the shaft 27 in the direction of double headed arrow CX by means of locking screws 37 which engage shaft 27.

Similarly, the transfer cone 28 may be axially and circumferentially adjusted relative to etch cone 26 to insure that both cones share a common apex A, along center line CL and further that the cones are in registration with other print stations. (Not shown).

Drive power for each print station assembly 20 comes from a driven rotating ring gear 62 which powers pinion 38 mounted commonly with angular bevel gear 36 and transfer cone 28. Etch cone 26 is preferably turned in an integral ratio with the transfer cone 28 via gear combination 34–36.

Ring gear 62 is carried by turret 61, and rotatably driven about center line CL by a drive not shown. Collector 65 is carried by turret 61 and engages transfer surface 30 in intimate contact.

Figure 5:
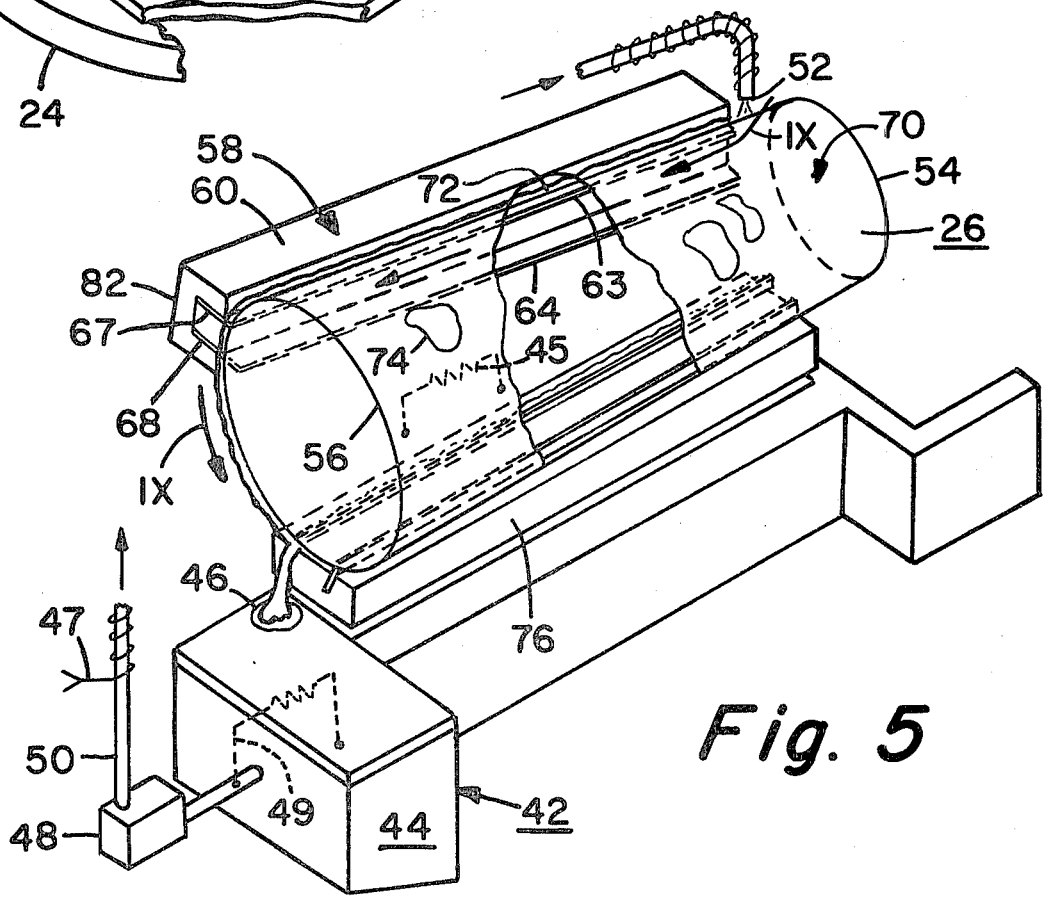
FIG. 5 is a perspective view of ink circulation and doctor/applicator devices incorporating the principles of the present invention.

FIG. 5 shows a detailed illustration of a preferred embodiment of an ink application assembly 42. A heated bath 44 holds a quantity of liquid ink 46. A pump 48, such as a Gerotor manufactured by W. H. Nichols Co., in flow communication with the bath 44 circulates a viscous fluid ink 46 via a heated pipe 50 to outlet 52 for deposition at an inboard or small end 54 of etch cone 26. (See arrows Ix) The etch cone has a surface portion 70 onto which the ink 46 flows from the inboard end 54 to an outboard end 56 thereof. Deposited ink 46 is carried by the surface 70 of etch cone 26 against a free floating applicator blade assembly 58 for spreading an even film of ink 46 onto said surface portion 70. The applicator blade assembly 58 includes a support block 60 carrying respective upper and lower blades 63 and 64 in corresponding slits 67 and 68. The ink 46 moves along the etch cone 26 in the direction of arrows Ix from the inboard end 54 of the outboard end 56 because the angle of incline of the applicator blade assembly 58 is higher at the inboard end 54 of etch cone 26 than the outboard end 56. The ink 46 also moves in the direction shown because the rotating cone surface 70 moves the viscous fluid against the blade 63 and creates a high pressure region within the ink 46 at an interface 72 between blade 63 and surface 70. The ink 46 is moved by gravitational and pressure forces along the interface or line of contact 72 between blade 63 and etch cone surface 70. Thereafter the ink 46 follows the etch cone surface 70 to the ink batch 44 completing the circulation path. The circulation maintains a continuous supply of ink 46 to fill design impressions 74 in the etch cone surface 70. Respective upper and lower blades 63 and 64 may also act as doctor blades to remove excess ink 46. Because the applicator blade assembly 58 may serve the dual purposes of application of ink 46 onto etch cone 26 and doctoring excess ink 46 from the surface 70 thereof, it will be detailed hereinafter. However, a backup doctor blade assembly 76 may be optionally used for the dual purpose noted above. The free floating feature described below with respect to the FIG. 6 applies equally to applicator blade assembly 58 and the doctor blade assembly 76.

Referring now to FIG. 4 the following is a brief description of the operation of the ink applicator assembly 20 incorporating the apparatus of the present invention. As turret 61 (centered at CL) rotates, it synchronously drives ring gear 62, etch cone 26 and transfer cone 28. If more than one color is required, as contemplated, more sets of ink applicator assemblies 20 may be provided. Each etch cone 26 receives a supply of ink as hereinbefore described with respect to FIG. 5. Design impressions 74, etched or engraved in the surface 70 of etch cone 26, receive the ink 46, after application and doctoring, by respective self aligning doctor and applicator devices 60 and 76. Thereafter, an ink formed design is available for offset to silicone surface 30 carried by transfer cone 28. It should be understood that silicone surface 30 carried by transfer cone 28 has an apex A which lies along center line CL of turret 61. That part of the etch cone 26 carrying the ink filled impressions 74 and silicone surface 30 roll in intimate contact against each other. The ink 46 in the impressions 74 form a design portion 88 to be transferred as a semi solid cohesive mass from the etch cone 26 to the silicone surface 30 carried by transfer cone 28. One or more collectors 65, carried by a rotating turret 61, encounter each successive printing station 20 at circumferential locations (see Ser. No. 332,726 filed Dec. 21, 1981 (for greater detail). Each collector 65 receives a corresponding portion of a composite design (not shown) on its working surface 86 from each successive printing station 20 in registration with the others. At a print transfer station, shown in the above application, the composite design may be transferred to ware. The design portion 88 is transferable because each successive surface encountering the ink 46 has a higher affinity for it than the previous one. See also U.S. Pat. Nos. 4,280,939, 4,261,749 and 4,292,104, for details of such surfaces and inks.

In the present invention it is intended that the inks 46 be of a thermoplastic type. For such inks it is required that they be maintained at a selected temperature at or near a suitable working point. Thus, etch cone 26, pipe 50 and bath 44 are heated by resistance heaters 45, 47 and 49, respectively.

Figure 6:
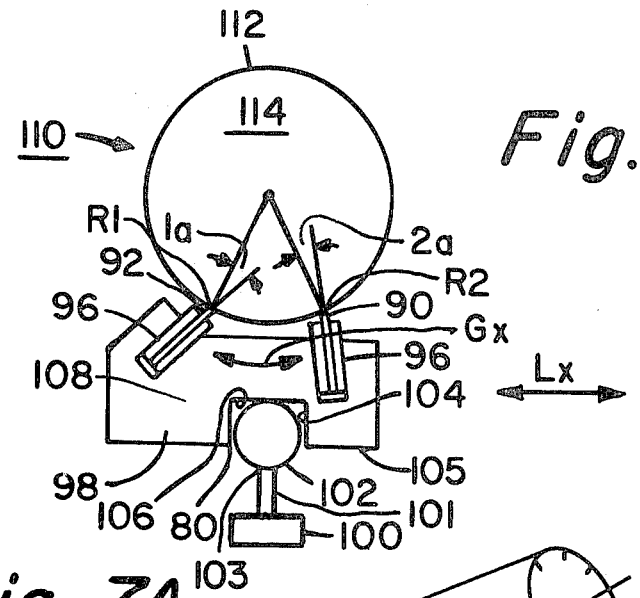
FIG. 6 is a schematic of a floating doctor/applicator feature of the present invention.

FIG. 6 is a detailed illustration of a resilient or floating bearing arrangement 110 for engagement with a surface 112 of a cone 114. A blade assembly 108 is similar in construction to both the respective applicator and doctor blade assemblies 58 and 76 shown in FIG. 4.

FIGS. 6, 7A–C and 8 best illustrate the typical relationship between the blade assembly 108 and the cone 114. In FIG. 6 a pneumatic piston 100 urges the blade assembly 108 into and out of engagement with cone 114. Respective right and left blades 90 and 92 are held in slots 96 of blade holder 98 at acute angles 1*a* and 2*a* to the surface of the cone 114. Each is made to contact the cone 114 along a respective ray R1,R2 of the cone surface 112. Two blades 90–92 are used for self alignment purposes. Thus, the blade holder 98 need only to be urged towards the cone 114 to case both blades 90–92 to come into intimate contact therewith. The arrangement of apex coincidence causes the blades to seat or lock into position. Positioning is required to locate blade holder 98 in the direction of double headed arrow RX (see FIG. 8) relative to the etch cone 114 along ray or lines of contact R1 and R2 thereby assuring proper blade to cone contact. Pneumatic piston 100 maintains the blade assembly 108 in radial position as hereinafter described.

The free floating feature of the blade assembly 108 is accomplished by means of a floating bearing. Pneumatic piston 100 carries drive pin 101. A ball bearing 102 may be secured to distal end 103 of pin 101. A hole 80 having sidewalls 104 and flat bottom 106 is formed in rear face 105 of holder 98 and receives ball bearing 102 therein. The holder 98 is free to gimbal in the direction of double headed arrow GX as shown. When pneumatic piston 100 is actuated, ball bearing 102 driven by pin 101 moves against flat bottom 106 of hole 104 to drive the holder 98 and blades 90 and 92 against surface 112 of cone 114. The blades 90 and 92 seat against the cone 114 along respective rays R1 and R2.

Blade holder 98 is shown secured to a support 116, the position of which may be adjusted in the ray direction RX (see FIG. 8) and lateraly thereof in the direction LX (see FIG. 6). The support 116 carries a pair of the pneumatic pistons 100 in fixed spaced relation. The holes 80 in blade support are located to correspond to the spaces of the ball bearings 102. The holder 98 is set over the support 116 to receive the ball bearing 102 in holes 80. Ball bearings engage sidewalls 104 of the holes and thereby prevent ray direction RX and lateral direction LX motion of the holder 98 and support 116, and yet allow gimballing motion GX. The support 116 carrying blade holder 98 and blades 90–92 may be positioned during setup to bring the blades 90–92 into apex alignment with cone 114. Thereafter gimballing motion allows the blades 90 and 92 to float and seal against cone 114.

Figure 7A:
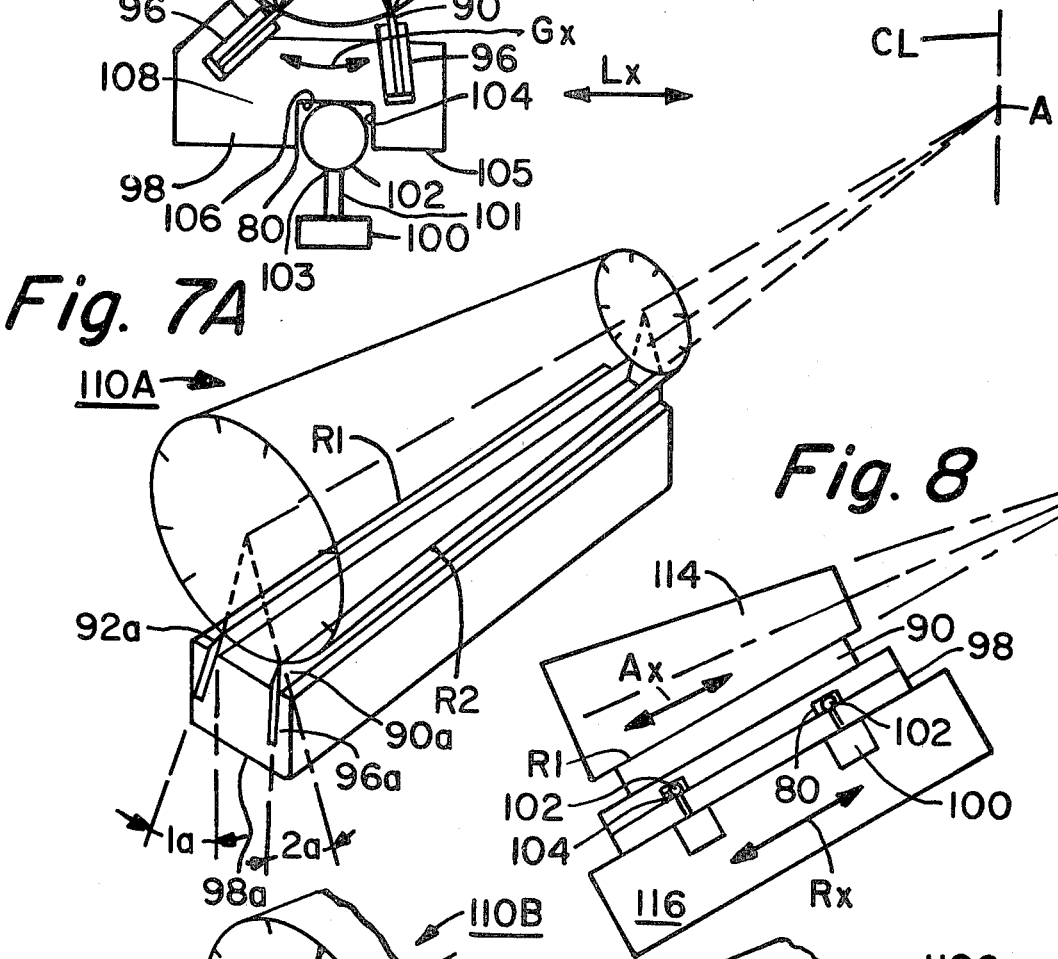
FIGS. 7A–7C illustrate schematic alternative embodiments of the doctor/applicator feature.
Figure 8:
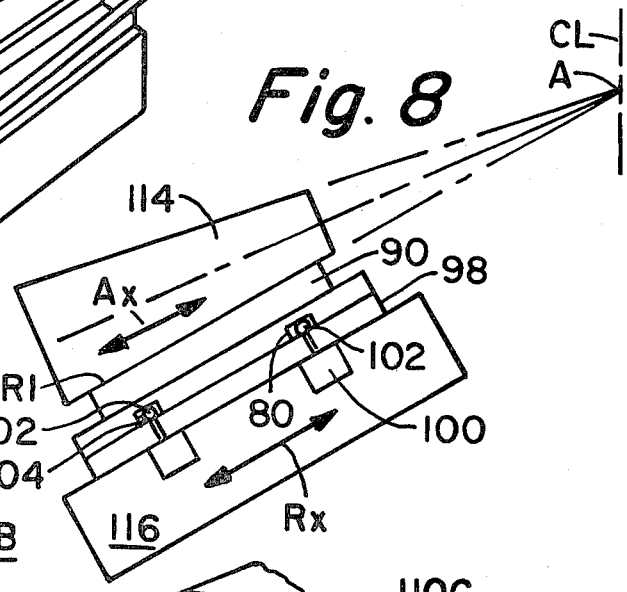
FIG. 8 is a detail of a support for the doctor/applicator feature described.
Figure 7B:
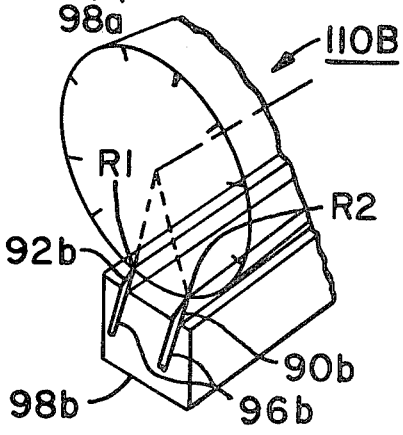
Figure 7C:
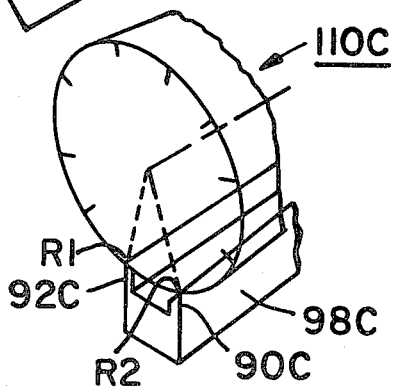

In FIG. 7A, as in all of the contemplated applicator/-doctoring assemblies, the apex A for the blades **90*a* and 92*a* as well as respective locating slots 96*a* of holder 98*a* and cone 114*a* each have an apex A which substantially concides on center line CL. While the angles 1*a*, and 2*a* of blades 90*a* and 92*a* may be different from those illustrated in FIG. 6, the same resulting self alignment occurs. FIG. 7B show blades 90*b* and 92*b* located in respective slots 96*b* of holder 98*b* both leading to the right. In FIG. 7C the assembly 110*c*, blades 90*c*–92*c* and holder 98*c*** are part of an integrally formed machined block.

An alternative embodiment of the etch cone 26 having engraved impressions therein is a smooth inking roll capable of receiving a cohesive film of ink 46 thereon. The line of contact 72 between the applicator device 58 and a smooth ink roll would be gauged to produce such thin film. Silicone surface 30 carried by transfer cone 28 could have flexographic impressions therein to make a design (not shown).

It has been found that the free floating feature of the present invention has allowed the continued use of the blade assemblies described herein for many cycles of operation without replacement. This is important in terms of machine down time, the expense of replacement of blades and ultimately the number of selects of the printed ware.

While there have been described what at present are considered to be the preferred embodiments of the present invention, it will be apparent to those skilled in the art that various changes and modifications may be made therein without departing from the invention and is intended to cover such changes and modifications as fall within the true scope and spirit of the appended claims.

We claim:

1. In an apparatus for applying ink to an ink carrying roll, a self aligning roll and doctor assembly comprising: a tapered conical roll having a conical surface mounted for rotation about a longitudinal axis having an apex therealong; doctoring means including a pair of blade members fixed within said doctoring means and each having a working surface, means for mounting said doctoring means in aligned engagement with said conical surface with freedom to gimbal the working surface of each of said blade members so as to lie in close contact with said conical surface along lines of contact each having a locus of points common to the conical surface of said conical roll and intersecting the apex thereof.

2. An apparatus as defined in claim 1 wherein the mounting means includes means for urging the working surfaces against the conical surface under predetermined pressure.

3. The apparatus of claim 2 wherein the means for urging the working surface includes an actuator in radial opposition with the conical surface for engaging said doctoring means.

4. An apparatus as defined in claim 3 wherein the actuator means comprises a piston having a distal end coupled to the doctoring means and urging it towards the conical surface.

5. An apparatus as defined in claim 4 wherein the actuator includes a floating bearing intermediate between the doctoring means and the piston for coupling the piston with the rearwardly remote portion of the doctoring means.

6. An apparatus as defined in claim 5 wherein the floating bearing includes a ball bearing means intermediate the piston and the doctoring means, said ball bearing means permitting circumferential gimballing of the doctoring means relative to the conical roll.

7. The apparatus of claim 6 wherein said doctoring means has an opening therein in the form of a socket in opposition to the blade members for receiving the ball bearing therein.

8. An apparatus as defined in claim 6 wherein the floating bearing includes means for maintaining the ball bearing means and the doctoring means in fixed ray relation with each other relative to said apex.

9. An apparatus as defined in claim 1 including means for locating the conical roll and doctoring means in common ray relation with each other relative to said apex.

10. An apparatus as described in claim 9 further including: means for depositing an ink fluid at one end of the conical roll near the doctoring means, means for collecting overflow from an opposite end thereof, the said doctoring means and conical surface being oriented for allowing gravity flow of the inking fluid from the first mentioned end to the opposite end thereof.

11. An apparatus as defined in claim 2 further including the means for circulating an ink comprising a reservoir of ink, a pipe in communication therewith, said pipe having an outlet located near an end of the conical roll and means for pumping the ink through the pipe to the outlet thereof for deposition on the roll.

12. An apparatus as defined in claim 1 wherein the ink is a thermoplastic material and said pipe conical roll and reservoir include heating means for maintaining the temperature of the ink at a selected working temperature.

13. An apparatus as defined in claim 11 wherein the reservoir has an opening located at the end of the conical roll remote from the pipe, said opening for receiving overflow of the ink from said conical roll.

14. An apparatus as described in claim 9 further including: means for depositing a viscous ink fluid onto the conical surface near said doctoring means, the conical roll being rotatable for carrying the ink against the doctoring means in order to produce a zone of relatively higher pressure in the ink at an interface of the doctoring means and the conical roll along the line of contact therebetween for urging the ink therealong from one end of said conical roll to another.

15. An apparatus as defined in claim 9 wherein the conical roll has an axial bore therein and a shaft is sleevably located therein for supporting said conical roll, and said means for locating the conical roll includes means for establishing an axial position of the conical roll relative to the shaft.

16. An apparatus as defined in claim 15 further including means for locating the conical roll circumferentially relative to the shaft.

17. An apparatus as defined in claim 1 wherein the working surfaces of said blade members are fixed relative to each other, and said mounting means including gimbal means for causing said blade members to slidably seat against the roll along their rays in apex coincidence with said conical roll.

18. An apparatus as defined in claim 1 wherein said doctoring means comprises an integral block and said blade members are projections extending therefrom.

19. An apparatus as defined in claim 1 further including second doctoring means for engaging the conical surface at a circumferentially located portion downstream of the first mentioned doctoring means, said second doctoring means having working surfaces for closely engaging said conical surface along a line of contact having a locus of points common to the surface of the conical roll and intersecting the apex thereof.

20. An apparatus as defined in claim 1 further including a second tapered conical surface for intimately contacting the first mentioned conical surface, said second conical surface having a centrally located longitudinal axis and apex therealong and being mounted for rotation along said axis with its apex coincident with that of the first mentioned conical roll, said second conical roll having a conical surface portion engaging, in a nonslip relation, the first conical roll for receiving therefrom ink deposited on the latter along a line of contact having a locus of points common to each one of said first and second conical rolls and intersecting said coincident apexes and the apex of the rays along said working surfaces.

21. A method for applying inking fluid to an ink carrying surface comprising the steps of: mounting a conical surface for rotation about a central axis, establishing an apex for said conical surface along said axis; gimbal mounting at least one doctoring means having a pair of doctoring surfaces for engagement in close contact with the conical surface so that each doctoring surface will lie along a line of contact having a locus of points common with the conical surface and intersecting the apex of the conical surface, and rotating the conical surface about its axis while at the same time applying inking fluid thereon.

22. A method as defined in claim 21 further including the step of urging the doctoring surfaces against the conical surface under predetermined pressure.

23. A method as defined in claim 22 wherein urging the doctoring surfaces includes the step of floatably bearing the doctoring surfaces against the conical surface.

24. A method as defined in claim 23 wherein floatably bearing said doctoring surfaces includes the step of allowing the doctoring surface to gimbal circumferentially relative to axis of rotation of the surface.

25. A method as defined in claim 21 including the step of fixing the doctoring surfaces relative to each other and slidably seating the same against said conical surface along rays intersecting said apex.

26. A method as defined in claim 25 wherein the step of applying inking fluid includes the steps of: depositing an inking fluid at one end of the doctoring surfaces and collecting overflow from an opposite end thereof; orienting the respective doctoring and conical surfaces for allowing gravity flow of the inking fluid from the first mentioned end to the opposite end thereof.

27. A method as defined in claim 26 wherein the inking fluid is a thermoplastic material and the step of applying the inking fluid includes the step of heating the inking fluid at a selected working temperature.

28. A method as defined in claim 26 wherein the step of applying the inking fluid comprises piping inking fluid from a reservoir in communication therewith, to an outlet thereof near an end of the surface and pumping the inking fluid therethrough.

29. A method as defined in claim 25 wherein the step of applying the inking fluid includes the step of depositing an inking fluid onto the conical surface, further including the step of rotating the conical surface into the doctoring surfaces and establishing a relatively higher fluid pressure in the inking fluid along an interface between the conical surface and the doctoring surfaces for driving the inking fluid therealong.

30. A method as defined in claim 25 further including the step of intimately contacting a second surface with the first mentioned surface, establishing an axis and apex for said second surface, mounting said second surface for rotation about said axis with its apex coincident with that of the first mentioned surface, engaging the first and second surfaces, rotating the surfaces in intimate nonslip rolling contact and transferring inking fluid deposited on the first mentioned surface onto the second surface along a line of contact having a locus of points common to each and intersecting said coincident apexes and the apex of the rays along said doctoring surfaces.

* * * * *